US006120101A

United States Patent [19]

Zimmerman

[11] Patent Number: 6,120,101

[45] Date of Patent: Sep. 19, 2000

[54] CHAIR FRAME CONSTRUCTION

[75] Inventor: James E. Zimmerman, Thaxton, Va.

[73] Assignee: Sam Moore Furniture Industries, Bedford, Va.

[21] Appl. No.: 09/178,017

[22] Filed: Oct. 23, 1998

[51] Int. Cl.[7] ..... A47C 7/02

[52] U.S. Cl. ..... 297/452.18; 297/344.21; 297/259.4

[58] Field of Search ..... 297/258.1, 259.1, 297/263.1, 263.2, 264.1, 265.1, 445.1, 452.18, 452.52, 344.21, 344.24

[56] References Cited

U.S. PATENT DOCUMENTS

| | | |
|---|---|---|
| 2,343,494 | 3/1944 | Burdick . |
| 2,866,498 | 12/1958 | Melbourne et al. . |
| 3,053,570 | 9/1962 | Fox . |
| 3,256,041 | 6/1966 | Armstrong . |
| 3,754,585 | 8/1973 | Clark . |
| 5,678,897 | 10/1997 | Prestia . |

FOREIGN PATENT DOCUMENTS

| | | | |
|---|---|---|---|
| 2440711 | 7/1980 | France | 297/445.1 |

*Primary Examiner*—Milton Nelson, Jr.
*Attorney, Agent, or Firm*—Harness, Dickey & Pierce, P.L.C.

[57] ABSTRACT

An improved chair frame and method of fabrication is disclosed in which an extremely rigid uniframe chair construction can be assembled from a variety of components fabricated out of sheets of plywood. The chair frame includes a base frame assembly having a one-piece D-shaped base plate upon which one or more side plates may be stacked and secured to achieve the desired base frame assembly thickness. The chair frame also includes a back frame assembly having a pair of back posts and a pair of front posts secured to the base frame assembly. A top rail interconnects the rear posts and a pair of arm rails interconnect the front posts and the rear posts. The various components of the chair frame are interconnected with mechanical joints to further enhance the strength and structural rigidity of the chair frame.

26 Claims, 5 Drawing Sheets

FIG 2
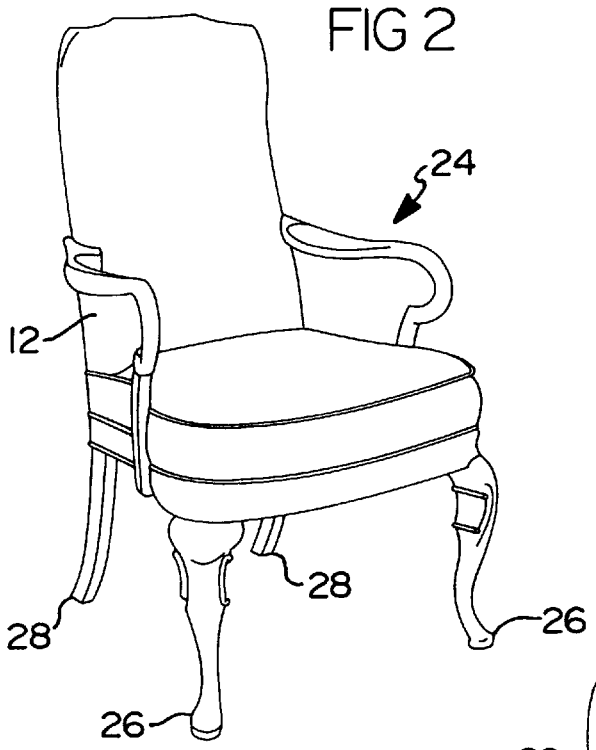
FIG 1
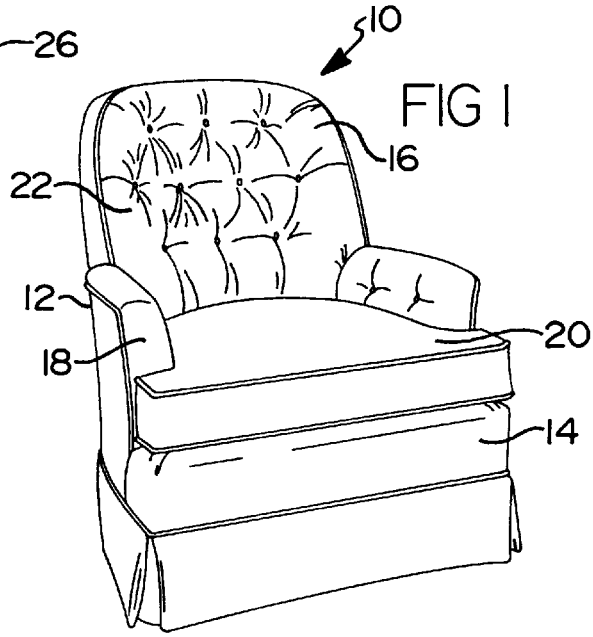
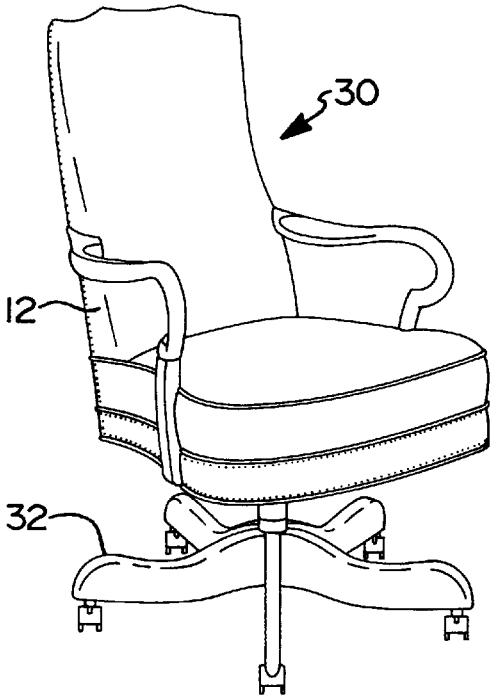
FIG 3

CHAIR FRAME CONSTRUCTION

BACKGROUND OF THE INVENTION

1. Technical Field

The present invention relates to an upholstered chair frame, and more particularly to a uniframe chair frame construction in which individual components of the frame are fabricated from flat sheets of plywood and assembled in such a manner to yield an extremely rigid frame construction.

2. Description of Related Art

In general, an upholstered chair includes a chair frame which supports various padding and upholstery, as well as seat springs, seat back springs and cushions. Historically, these chair frames have been fabricated from various laminated frame components. More specifically, thin pieces of wood are glued together and laid up in a fixture which forms the proper contouring and shape for a particular frame part. Once the adhesive has set, these parts are removed from the fixture and trimmed. Finally, the various parts are glued together into the chair frame with certain critical joints being reinforced with corner blocks or similar stiffening members.

While acceptable, this method of fabrication is time consuming and costly in that it requires the manufacture and inventory of many different parts which are specific to a given chair design. Moreover, fabrication of the contoured components also increase the dimensional variations from part to part due to difference in the wood, adhesive and environment. In addition, the number of joints in the chair frame weaken the overall stiffness of the chair frame.

SUMMARY OF INVENTION

In accordance with the present invention, an improve chair frame and method of fabrication is disclosed. The chair frame includes a base frame assembly having a D-shaped or one-piece base plate upon which one or more side plates are stacked and glued together to achieve a desired base frame assembly thickness. In this manner, the joints between the base plate and the side plates are in a plane of sheer and not a plane of bending which yields an extremely stiff base frame assembly. The chair frame also includes a back frame assembly having a pair of back posts and a pair of front posts secured to the base frame assembly and extending upwardly therefrom. A top rail interconnects the rear posts, and a pair of arms interconnect the front posts with the rear posts. The components of the chair frame can be cut from a sheet good such as plywood preferably by computerized numerically controlled (CNC) machinery. Furthermore, specific mechanical fastening features can be formed into the base frame assembly because of the stacked relationship of the components thereof. In this way, interlocking joints can be used to connect the base frame assembly with the back frame assembly.

Thus, a primary object of the present invention is to provide a chair frame for use in an upholstered chair which is extremely rigid, while at the same time cost-effective.

Another object of the present invention is to eliminates the use of contoured, laminated components and to minimize the number of joints in the chair frame.

A further object of the present invention is to provide a chair frame design and method of assembly which is readily adaptable for automated fabrication through the use of computerized numerically controlled machinery.

An additional object of the present invention is to provide a chair frame design which maximizes the use of raw materials such as plywood and minimize the waste thereof.

Still another object of the present invention is to provide a chair frame design which is more simple and faster to fabricate.

These and other objects, features and advantages of the present invention will become apparent from the following detailed description when viewed in accordance with the accompanying drawings and appended claims.

BRIEF DESCRIPTION OF THE DRAWINGS

FIG. 1 is a perspective view of an upholstered swivel base rocking chair which incorporates the frame construction of the present invention;

FIG. 2 is a perspective view of an upholstered highback chair which incorporates the frame construction of the present invention;

FIG. 3 is a perspective view of an upholstered desk chair which incorporates the frame construction of the present invention

DETAILED DESCRIPTION OF THE PREFERRED EMBODIMENT

Figure 4:
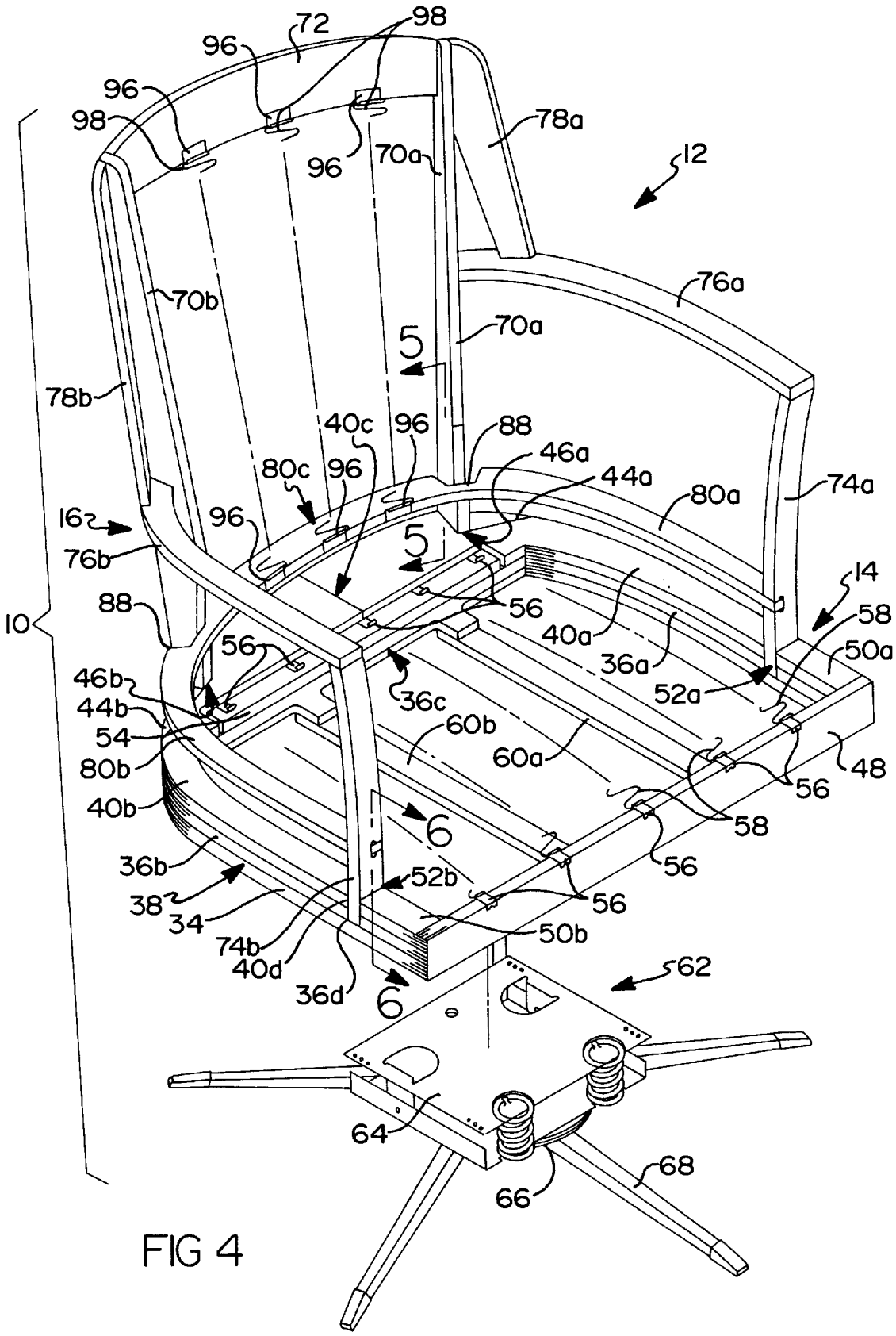
FIG. 4 is an exploded perspective view of the present invention in which the upholstery, padding, and cushions have been removed.

Referring now to FIG. 1, the present invention is illustrated in a swivel base rocker 10 having an upholstered chair frame 12 including a base frame assembly 14 and a back frame assembly 16 which are covered by upholstery 18. Seat cushion 20 and back cushion 22 are supported by chair frame 12 to provide an occupant supporting surface. The present invention is readily adaptable for use in other chair configurations such as a highback occasional chair 24 as illustrated in FIG. 2 having an upholstered chair frame 12 and a pair of front legs 26 and a pair of rear legs 28 extending downwardly therefrom. Alternately, the present invention may be incorporated in to a desk chair 30 as illustrated in FIG. 3 having an upholstered chair frame 12 and a five-prong base standard 32. While the present invention is further described with specific reference to the swivel base rocker 10 illustrated in FIG. 1, one skilled in the art should readily recognize that the present invention can be used for a variety of furniture frames associated with different upholstered chairs, as well as love seats and sofas.

With particular reference now to FIG. 4, upholstered chair frame 12 is illustrated with the upholstery and padding removed and includes base frame assembly 14 and back frame assembly 16. A majority of the components of chair frame 12 are fabricated from a flat, wooden sheet good such as plywood and assembled in a manner to provide a uniframe construction. Base frame assembly 14 includes base plate 34 which is a one piece component having a closed, D-shaped peripheral configuration, a first side plate 36 secured with an adhesive to an upper surface 38 of base plate 34 and a second side plate 40 secured with an adhesive to an upper surface 42 of first side plate 36 which when assembled form a base plate assembly. While first and second side plates 36, 40 may be fabricated from a single piece, it is presently preferred to fabricate first and second side plates 36, 40 from multiple pieces to optimize the use of the plywood sheet goods. More specifically, first side plate 36 and second side plate 40 are divided into left side portions 36*a*, 40*a* and right side portions 36*b*, 40*b* and joined at first and second side plate butt joints 36*c*, 40*c*. First and second side plates terminate at first and second forward ends 36*d*, 40*d*.

The configuration of base frame assembly 14, and more particularly the stacked configuration of a one-piece, D-shaped base plate and multiple side plates is such that the joints therebetween are in a plane of sheer and not in a plane of bending, thereby yielding an extremely rigid base frame assembly. Moreover, the closed peripheral configuration of base plate 34 eliminates the need for utilizing corner blocks for triangulation of the critical joints in base frame assembly 14.

Base frame assembly 14 further includes a pair of rear post filler blocks 44*a*, 44*b* secured along a rear edge portion of the base plate assembly to define back post slots 46*a*, 46*b* in base frame assembly 14. A front rail 48 is secured to a front edge of base plate 34 with a suitable adhesive and fastener. A pair of forward side rails 50*a*, 50*b* are secured to upper surface 38 of base plate 34 and extend from front rail 48 towards first side plate 36 and second side plate 40 to define front post slots 52*a*, 52*b* in the base plate assembly. A back rail 54 is secured along an interior rear edge of the base plate assembly. A plurality of spring clips 56 are disposed along an upper edge of front rail 48 and back rail 54 and are adapted to receive a serpentine-type seat spring 58 for supporting seat cushion 20 of swivel base rocker 10.

Base frame assembly 14 further includes transverse slats 60*a*, 60*b* for operably coupling chair frame 12 with a swivel rocker base assembly 62. More specifically, a rocker mechanism 64 is secured to slats 60*a*, 60*b*, a swivel plate mechanism 66 is secured to rocker mechanism 64 and a stationary base 68 is secured to swivel plate 66. Rocker mechanism 64 is a spring-biased rocking mechanism as conventionally known in the art which provides rocking motion of chair frame 12 relative to stationary base 68. Similarly, swivel plate 66 is a ball bearing-type swivel plate assembly as conventionally known in the art which provides a rotational degree of freedom between chair frame 12 and stationary base 68.

When used with alternate base configurations, such as those illustrated in FIGS. 2 and 3, the various base assemblies, such as legs 26, 28 or a five-prong base standard 32 may be secured to chair frame 12 in a manner as conventionally known in the art.

With reference again to FIG. 4, back frame assembly 16 secured to base frame assembly 14 to further define chair frame 12. More specifically, back frame assembly 16 includes a pair of back posts 70*a*, 70*b* disposed in back post slot 46*a*, 46*b* and extending upwardly from base frame assembly 14. A top rail 72 extends between back posts 70*a*, 70*b* and is secured thereto with a threaded fastener and dowelled joint. A pair of front posts 74*a*, 74*b* are disposed within front post slot 52*a*, 52*b* and extend upwardly from base frame assembly 14. A pair of arm rails 76*a*, 76*b* extend from front posts 74*a*, 74*b* to back posts 70*a*, 70*b*. A pair of wings 78*a*, 78*b* extend upwardly and inwardly from arm rails 76*a*, 76*b* to an upper portion of rear posts 70*a*, 70*b* adjacent top rail 72. Back frame assembly 16 further includes a side slat 80 which is parallel to but spaced apart from base frame assembly 14 and secured between front posts 74*a*, 74*b* and rear posts 70*a*, 70*b*. As presently preferred, side slat 80 includes a left hand portion 80*a* and a right hand portion 80*b* joined at a side slat butt joint 80*c*. In this manner, base frame assembly 14, side slats 80*a*, 80*b*, and arm rails 76*a*, 76*b* define a generally U-shaped chair frame.

Alternate embodiments of the present invention, such as those illustrated in FIGS. 2 and 3 may include exposed wooden elements to provide a different aesthetic appearance. For example, the front posts and arm rails may be a continuous wooden component which is exposed and appropriately finished to provide an aesthetically appealing feature as shown in chair 24 and chair 30.

Figure 6:
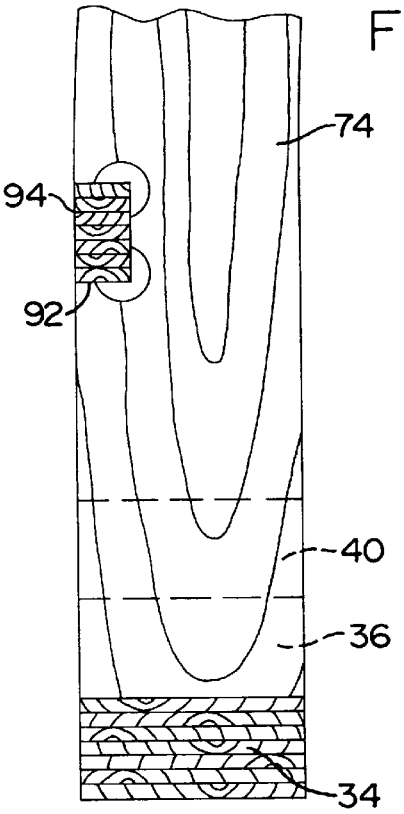
FIG. 6 is a cross-sectional view taken through a portion of the front post of the back frame assembly.
Figure 5:
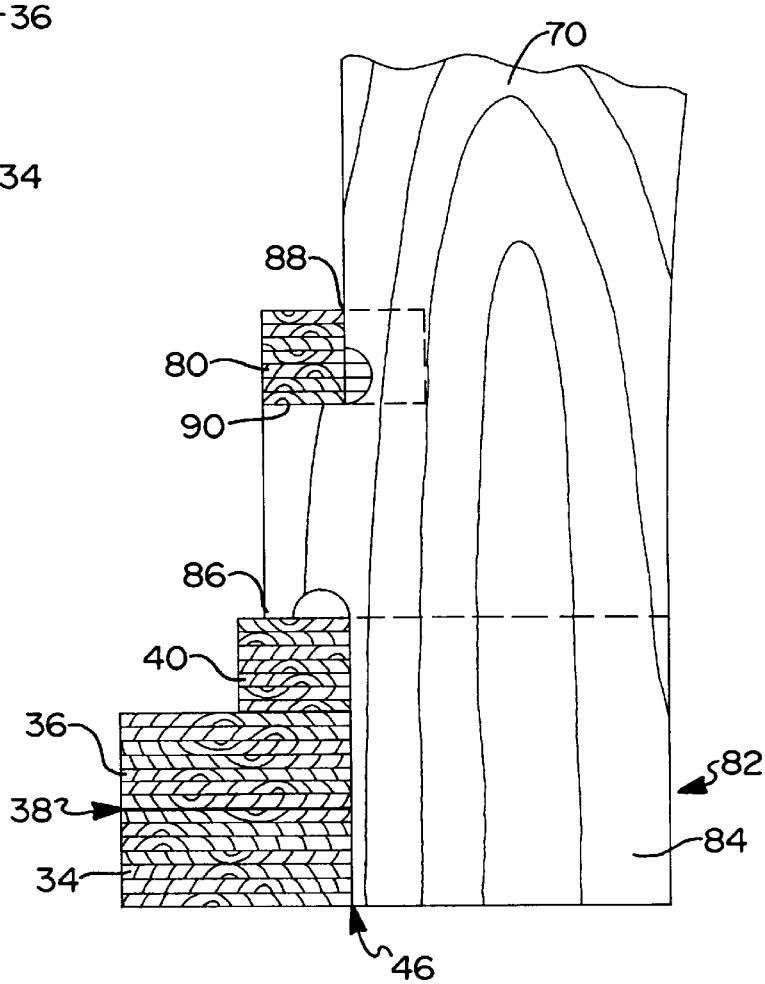
FIG. 5 is a cross-sectional view taken through a portion of the rear post of the back frame assembly.

With reference now to FIG. 5, back post 70 is interconnected with base frame assembly 14 at back post slot 46. More specifically, a tenon 82 is formed on a lower portion of back post 70 such that the vertical portion 84 of tenon 82 fits into and is captured by rear post slot 46, while a cheek portion 86 rests on top of base frame assembly 14. Similarly, the joint between rear post 70 and side slat 80 is mechanically interconnected to provide a more rigid chair frame In this regard, a notch 88 having a horizontal supporting surface 90 is formed in rear post 70 and is adapted to receive and support side slat 80. Likewise, as illustrated in FIG. 6, a mortise 92 is formed in front post 74 and adapted to receive a tenon 94 formed on a forward end of side slat 80. In this manner, the joints between the various components of back frame assembly 16 are mechanically coupled, thereby yielding an extremely rigid back frame assembly.

A plurality of spring clips 96 are disposed along a lower edge of top rail 72 and an inboard edge of side slats 80, 80'. A plurality of seat back springs 98 are secured to spring clips 96 and extend between top rail 72 and side slats 80, 80' for supporting back cushion 22.

Figure 7A:
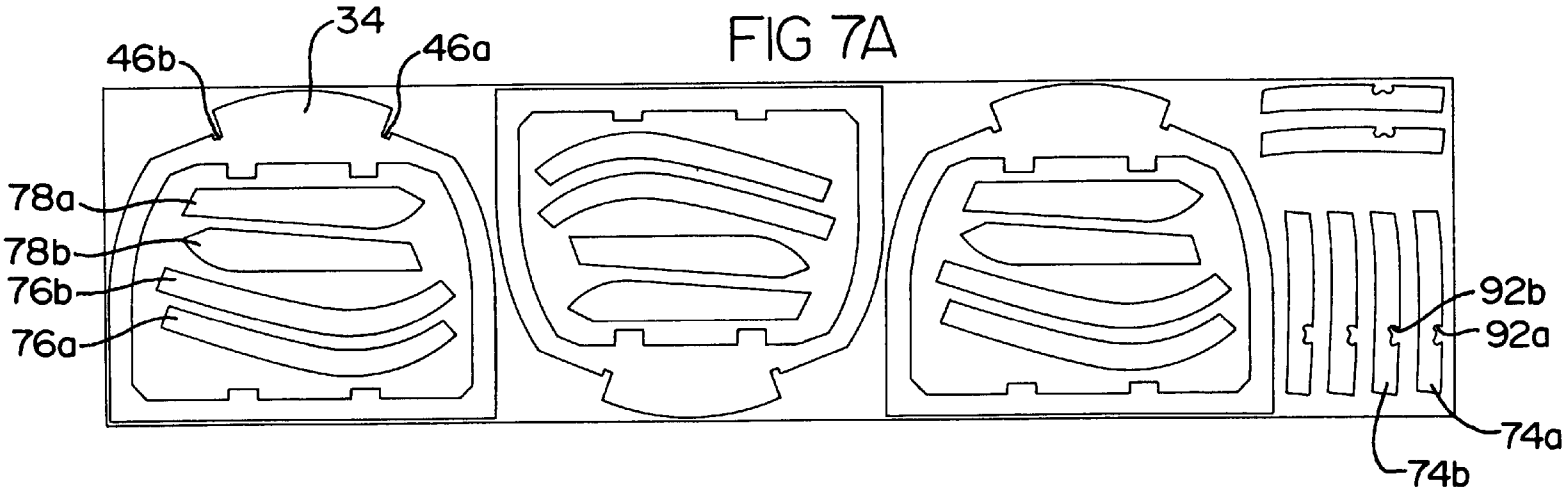
FIG. 7A–7E are plan views of the various components of the present invention as laid out on plywood sheets for cutting on CNC machinery.
Figure 7B:
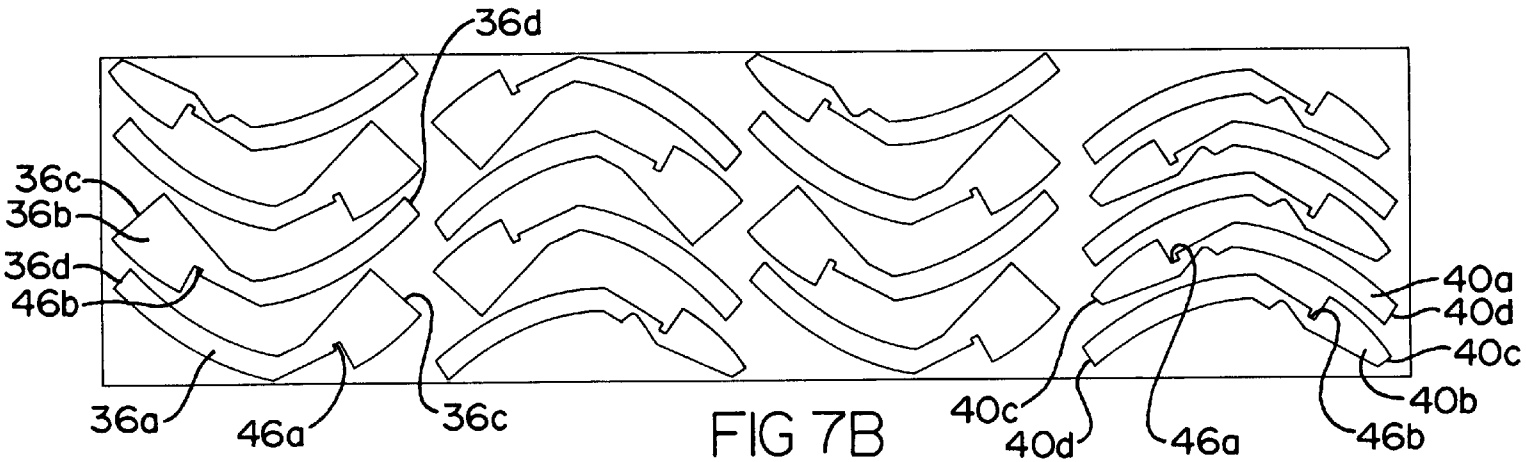
Figure 7C:
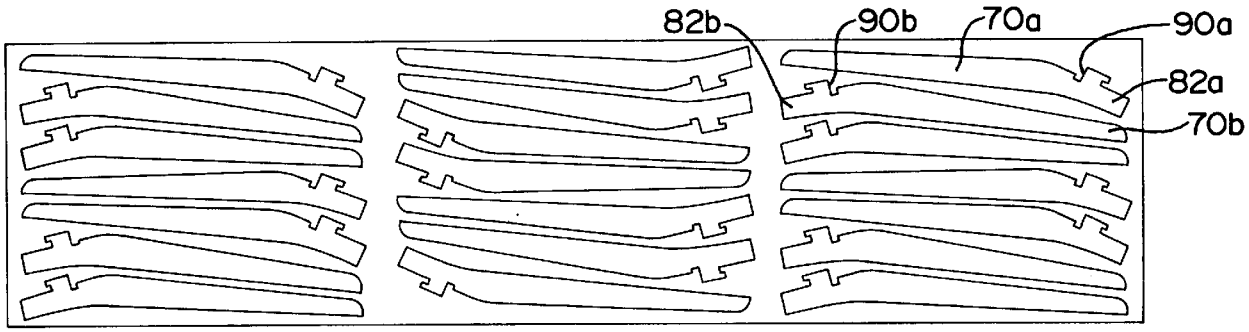
Figure 7D:
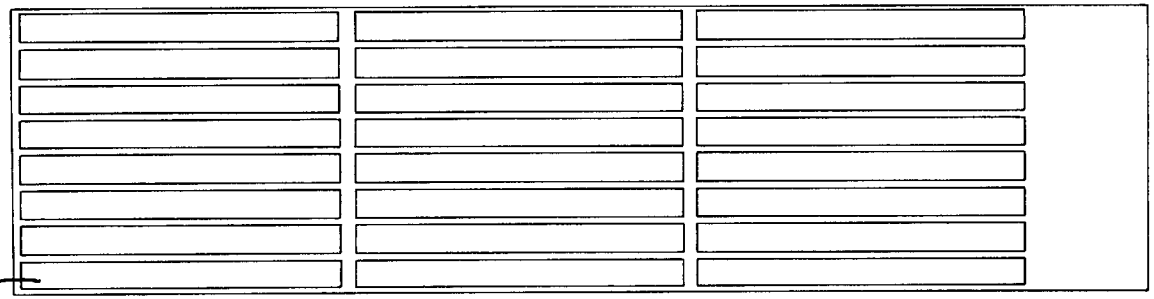
Figure 7E:
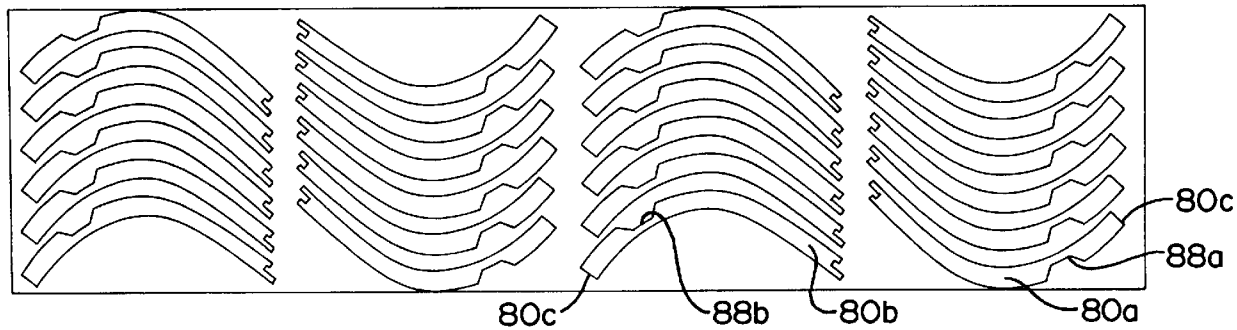

With continued reference now to the figures, the method of assembly for chair frame 12 will now be described. As previously mentioned, chair frame 12 is assembled from multiple components which are fabricated out of a sheet good. More specifically, a plurality of base plates 34, front posts 74, arm rails 76 and wings 78 may be cut out of a sheet of plywood. As presently preferred, a four foot by eight foot by seven-eighths inch (4'×8'×⅞") piece of furniture-grade is used wherein FIG. 7A illustrates a half-sheet layout therefor. Similarly, a plurality of first and second side plates 36, 40, back post 70, front rail 48 and side slats 80 can be formed out of similar pieces of plywood as illustrated in FIGS. 7B–7E, respectively. As such, all of the components illustrated in FIGS. 7A–7E can be cut from plywood sheets by computerized numeric controlled (CNC) machinery.

Next, base frame assembly 14 is fabricated by stacking base plate 34, first side plate 36, second side plate 40 together with a suitable adhesive such as wood glue distributed therebetween. A clamping force is applied to base frame assembly 14 by way of a clamping fixture or mechanical fastener such that the adhesive is permitted to cure while the components of base frame assembly 14 are maintained in proper orientation. As presently preferred, a stacking fixture (not shown) may be used to maintain proper alignment of base frame 14 during fabrication. Next, front posts 74 are glued and screwed to base frame assembly 14 at the forward edge of first and second side plates 36, 40. Front rail 48 is glued and screwed to base frame assembly 14 with a suitable adhesive and threaded fastener. Next, the forward side rails 50 is glued and screwed to the upper surface 38 of base plate 34 and is adapted to capture front posts 74. Back rail 54 is glued and screwed to the base plate assembly. Next, rear posts 70 are glued and stapled to the base frame assembly 14. Rear post filler blocks 44 are positioned adjacent rear posts 70 and secured to the base frame assembly 14 with a suitable adhesive and mechanical fastener such as a staple. Top rail 72 is secured between rear posts 70 with a dowelled joint, as well as a suitable adhesive and threaded fastener. Arm rails 76 are secured to a top portion of front posts 74 with wood glue and a suitable threaded fastener and secured to an intermediate portion of rear posts 70 with a dowelled joint, a suitable adhesive and threaded fastener. Side slat 80 is glued and stapled to front post 74, and then glued and stapled to rear post 70. Wing 78 is glued and stapled between arm rails 76 and rear post 70. Lastly, a particular base assembly, such as transverse slats 60, are glued and screwed to chair frame 12 in a manner as heretofore described.

At this point, chair frame 12 is ready for final assembly in which seat springs 58 and seat back springs 98 are secured to chair frame 12 by spring clips 56 and 96, respectively. Chair frame 12 may subsequently be upholstered with the padding, upholstery, and seat and back cushions are secured thereto for completion of final assembly.

As will be appreciated from the detailed description set forth above, the subjoined claims and the attached drawings, the frame construction of the present invention provides a frame which is more simple in design, easier and more cost effective to manufacture, and more structurally rigid than prior art frames. The present invention has been described in conjunction with a swivel base rocker chair, a highback chair and a desk chair as exemplary embodiments. While the foregoing discussion discloses and describes these exemplary embodiments, one skilled in the art will readily recognize that the present invention is adaptable for use in a wide range of upholstered furniture frame designs including love seat and sofas; and that various changes, modifications and adaptations can be made to the present invention without departing from the spirit and scope thereof as defined in the following claims.

What is claimed is:

1. A chair frame for use in an upholstered chair comprising:

a base frame assembly including a base plate and a first side plate secured to an upper surface of said base plate, wherein said base plate and said first side plate are flat and arranged in a horizontally stacked configuration; and a back frame assembly including a pair of rear posts secured to said base frame assembly along a rear edge thereof, a top rail secured between said pair of rear posts, a pair of front posts secured to said base frame assembly adjacent a forward edge of said base frame assembly, and a pair of arm rails secured between said pair of rear posts and said pair of front posts.

2. The chair frame of claim 1 wherein said base plate is a single piece having a closed peripheral configuration.

3. The chair frame of claim 1 wherein said base plate is D-shaped.

4. The chair frame of claim 1 wherein said first side plate includes a left side plate portion and a right side plate portion interconnected at a first side plate joint.

5. The chair frame of claim 1 wherein said base frame assembly further comprises a second side plate secured to said first side plate on a side opposite said base plate.

6. The chair frame of claim 5 wherein said second side plate includes a left side plate portion and a right side plate portion interconnected at a second side plate joint.

7. The chair frame of claim 1 wherein said base frame assembly further comprises a back post filler block secured to said base frame assembly adjacent each of said pair of rear posts.

8. The chair frame of claim 1 wherein said base frame assembly further comprises a rear rail secured to said base frame assembly adjacent said pair of rear posts.

9. The chair frame of claim 1 wherein said base frame assembly further comprises a front rail secured to a front edge of said base plate.

10. The chair frame of claim 9 wherein said base frame assembly further comprises a pair of forward side rails secured to said upper surface of said base plate between said front rail and said front posts.

11. The chair frame of claim 1 wherein said back frame assembly further comprises a side slat disposed parallel to but spaced apart from said base frame assembly and secured between said pair of front posts and said pair of rear posts.

12. The chair frame of claim 11 wherein said side slat has a first end having a first tenon formed thereon and a second end having a second tenon formed thereon, and each of said pair of front posts have a mortise formed therein for receiving one of said first and second tenons.

13. The chair frame of claim 12 wherein each of said pair of rear posts have a notch formed therein defining a horizontal surface for receiving and supporting said side slat.

14. The chair frame of claim 1 wherein said back frame assembly further comprises a pair of wings secured between said pair of rear posts and said pair of arm rails.

15. A chair frame for use in an upholstered chair comprising:

a base frame assembly including a D-shaped base plate a first side plate secured to an upper surface of said base plate and a second side plate secured to an upper surface of said first side plate, wherein said base plate, said first side plate and said second side plate are flat and arranged in a horizontally stacked configuration, a front rail secured to a front edge of said base plate, and a rear rail secured to a rear portion of said base frame assembly, a pair of forward side rails secured to said upper surface of said base plate between said front rail and said first and second side plates to define a first pair of slots in a front portion of said base frame assembly, and a pair of filler blocks secured to said base frame assembly such that said filler block, said base plate, said first side plate and said second side plate define a second pair of slots in a rear portion of said base frame assembly; and a back frame assembly including a pair of rear posts, each of said pair of rear posts disposed in one of said second pair of slots and secured to said base frame assembly, a top rail secured between said pair of rear posts, a pair of front posts each of said pair of front posts disposed in one of said first pair of slots and secured to said base frame assembly, a pair of arm rails secured between said pair of rear posts and said pair of front posts, and a side slat disposed parallel to but spaced apart from said base frame assembly and secured between said pair of front posts and said pair of rear posts.

16. An upholstered chair comprising:

a chair frame including a base plate assembly having a base plate, and a first side plate secured to an upper surface of said base plate, wherein said base plate and said first side plate are flat and arranged in a horizontally stacked configuration, a front rail portion formed at a front of said base plate and a rear rail portion formed at a rear of said base plate, a pair of rear posts secured to said base plate assembly along a rear edge thereof, a top rail secured between said pair of rear posts, a pair of front posts secured to said base plate assembly, and a pair of arm rails secured between said pair of rear posts and said pair of front posts;

a seat assembly including a seat spring secured to and extending between said rear rail portion and said front rail portion and a seat cushion supported on said seat spring; and a back assembly including a back spring extending between said pair of rear posts and a back cushion supported on said back spring.

17. The upholstered chair of claim 16 wherein said base plate is a single piece having a closed peripheral configuration.

18. The upholstered chair of claim 17 wherein said base plate is D-shaped.

19. The upholstered chair of claim 16 wherein said chair frame further comprises a back post filler block secured to said base plate adjacent each of said pair of rear posts.

20. The upholstered chair of claim 16 wherein said chair frame further comprises a pair of forward side rails secured to said base plate between said front rail portion and said pair of front posts.

21. The upholstered chair of claim 16 wherein said chair frame further comprises a side slat secured between said pair of front posts and said pair of rear posts parallel to but spaced apart from said base frame assembly.

22. The upholstered chair of claim 16 wherein said chair frame further comprises a pair of wings secured between said pair of rear posts and said pair of arms rails.

23. The upholstered chair of claim 16 further comprising:

a stationary base;

a swivel plate assembly operably disposed between said base plate and said stationary base to provide a rotational degree of freedom therebetween.

24. The upholstered chair of claim 16 further comprising:

a stationary base;

a rocker assembly operably disposed between said base plate and said stationary base to provide rocking movement of said chair frame relative to said stationary base.

25. The upholstered chair of claim 24 further comprising a swivel plate assembly operably disposed between said rocker assembly and said stationary base to provide a rotational degree of freedom therebetween.

26. The upholstered chair of claim 16 further comprising a plurality of legs extending from a lower surface of said base plate.

* * * * *